US007828676B2

(12) United States Patent
Wada et al.

(10) Patent No.: US 7,828,676 B2
(45) Date of Patent: Nov. 9, 2010

(54) GOLF CLUB HEAD

(75) Inventors: Kozue Wada, Chichibu (JP); Wataru Ban, Chichibu (JP); Hiroshi Takahashi, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 0 days.

(21) Appl. No.: 12/057,664

(22) Filed: Mar. 28, 2008

(65) Prior Publication Data

US 2009/0247320 A1 Oct. 1, 2009

(51) Int. Cl.
*A63B 53/04* (2006.01)

(52) U.S. Cl. ..... 473/346

(58) Field of Classification Search ..... 473/346
See application file for complete search history.

(56) References Cited

U.S. PATENT DOCUMENTS

| | | | | |
|---|---|---|---|---|
| 4,930,781 | A * | 6/1990 | Allen | 473/346 |
| 5,255,918 | A | 10/1993 | Anderson et al. | |
| 5,261,663 | A | 11/1993 | Anderson | |
| 5,261,664 | A | 11/1993 | Anderson | |
| 5,344,140 | A | 9/1994 | Anderson | |
| 5,346,218 | A | 9/1994 | Wyte | |
| 5,419,559 | A * | 5/1995 | Melanson et al. | 473/346 |
| 5,755,627 | A | 5/1998 | Yamazaki et al. | |
| 5,941,782 | A * | 8/1999 | Cook | 473/346 |
| 6,595,871 | B2 * | 7/2003 | Sano | 473/342 |
| 6,645,087 | B2 * | 11/2003 | Yabu | 473/342 |
| 6,783,465 | B2 | 8/2004 | Matsunaga | |
| 6,832,961 | B2 | 12/2004 | Sano | |
| 6,852,038 | B2 * | 2/2005 | Yabu | 473/224 |
| 6,878,073 | B2 * | 4/2005 | Takeda | 473/346 |
| 7,025,692 | B2 * | 4/2006 | Erickson et al. | 473/335 |
| 7,066,835 | B2 * | 6/2006 | Evans et al. | 473/346 |
| 7,273,423 | B2 | 9/2007 | Imamoto | |
| 7,553,241 | B2 * | 6/2009 | Park et al. | 473/290 |
| 7,651,414 | B2 * | 1/2010 | Rae et al. | 473/346 |
| 2005/0148405 | A1 | 7/2005 | Imamoto | |
| 2005/0221913 | A1 * | 10/2005 | Kusumoto | 473/345 |
| 2006/0128502 | A1 | 6/2006 | Imamoto et al. | |
| 2008/0051216 | A1 * | 2/2008 | Evans et al. | 473/346 |
| 2008/0132355 | A1 * | 6/2008 | Hoffman et al. | 473/346 |

FOREIGN PATENT DOCUMENTS

| | | | |
|---|---|---|---|
| JP | 06-031421 | A | 2/1994 |
| JP | 06-170020 | A | 6/1994 |
| JP | 2000-176056 | A | 6/2000 |
| JP | 2000-350798 | A | 12/2000 |
| JP | 2001-046559 | A | 2/2001 |
| JP | 2001-353240 | A | 12/2001 |
| JP | 2002-078833 | A | 3/2002 |
| JP | 2002-186691 | A | 7/2002 |
| JP | 2003-088601 | A | 3/2003 |
| JP | 2003-159354 | A | 6/2003 |
| JP | 2005-160947 | A | 6/2005 |
| JP | 2006-167279 | A | 6/2006 |
| JP | 2007-054166 | A | 3/2007 |
| JP | 2007-167622 | A | 5/2007 |

* cited by examiner

*Primary Examiner*—Stephen L. Blau
(74) *Attorney, Agent, or Firm*—Sughrue Mion, PLLC

(57) ABSTRACT

A golf head club has a high moment of inertia and thus produces a pleasing hitting sound. A metallic golf club head 1 having a hollow space therein includes a face member 30 provided with a face part 31, and a body member 10 provided with a sole part 11, a crown part 12, a side part 13, and ribs 20. The hollow space is defined by the inner surfaces of the face part 31, the sole part 11, the crown part 12, and the side part 13, and the wall surfaces of the ribs. The ribs 20 extend from the inner surface of the sole part 11 to the inner surface of the crown part 12, and the body member 10 is molded integrally by casting.

11 Claims, 9 Drawing Sheets

GOLF CLUB HEAD

BACKGROUND OF THE INVENTION

The present invention relates to a metallic golf club head having a hollow space therein.

Recently, golf club heads that are larger than conventional ones and have a flatter shape to yield a high moment of inertia have become commercially available. Although the club heads of this type have an advantage in being able to yield a high moment of inertia, they have a problem in that the natural frequency of the head is low, and therefore a low and muffled hitting sound, which is generally displeasing, is produced. If the head volume is increased to its limits within the range of specified weight, the wall thickness of head decreases, and also the head has a flatter shape, so that the areas of the sole and the crown increase. As a result, the natural frequencies of the sole and the crown decrease, which may adversely affect the hitting sound.

Japanese Unexamined Patent Application Publication No. 10-24128 describes a technique in which, in the hollow space of the golf club head, a plate-shaped rib for adjusting the hitting sound is provided on the inner surface of the sole only. Also, Japanese Unexamined Patent Application Publication No. 2002-186691 describes a technique in which, in the hollow space of the golf club head, plate-shaped ribs for adjusting the hitting sound are provided from the inner surface of the sole to the inner surface of a side.

SUMMARY OF THE INVENTION

Even if the rib proposed in the above-mentioned Publications is provided, when a high moment of inertia is desired, the problem still arises that a low and muffled hitting sound is produced. Specifically, if the golf club head is made large and flat to produce a high moment of inertia, the head deforms greatly, that is, the crown and the sole vibrate greatly at the time of impact with a golf ball, which may produce a low and muffled hitting sound.

Accordingly, an object of the present invention is to provide a golf club head that has a high moment of inertia and thus produces a good hitting sound.

To achieve the above object, a golf club head having a hollow space therein in accordance with the present invention includes a first member provided with at least a face part and a second member provided with at least a part of a sole part, at least a part of a crown part, at least a part of a side part, and a rib. The rib extends from the inner surface of at least a part of the sole part to the inner surface of at least a part of the crown part via the inner surface of at least a part of the side part. Also, the rib is cast integrally with at least a part of the sole part, at least a part of the crown part, and at least a part of the side part.

The rib may have a thickness of about 1 mm to about 4 mm. The rib can have a horizontal length Ls from the side part to the sole part of about 30 mm to about 70 mm. The rib may have a weight of about 5 g to about 40 g.

The rib may have substantially a C shape extending from the inner surface of the crown part to the inner surface of the sole part via the inner surface of the side part. The horizontal length Ls from the side part to the sole part can be equal to or greater than a horizontal length Lc of the rib from the side part to the crown part. The thickness of the rib in a tip end portion on the head center side can be thinner than that in a portion that is in contact with the inner surface of the sole part, the inner surface of the side part, or the inner surface of the crown part.

According to the present invention, the rib provided in the hollow space of the golf club head is provided so as to extend from the inner surface of the sole part to the inner surface of the crown part via the side part, and the rib is molded integrally with the sole part, the crown part, and the side part by casting. Thereby, the rigidity of the sole part and the crown part is increased remarkably, and the natural frequency is increased. Also, since the sole part and the crown part are fixed firmly to each other by the rib, the area of a portion that vibrates freely at the time of impact with a golf ball decreases, so that the wavelength decreases, that is, the frequency increases. Therefore, because of a high moment of inertia, even if the head is made large and flat, the hitting sound can be improved.

BRIEF DESCRIPTION OF THE DRAWINGS

FIG. 6A is a perspective view, and FIG. 6B is a plan view;

FIG. 7A is a perspective view, and FIG. 7B is a plan view;

FIG. 8A is a perspective view, and FIG. 8B is a plan view;

FIG. 9A is a perspective view, and FIG. 9B is a plan view;

FIG. 10A is a perspective view, and FIG. 10B is a plan view;

FIG. 11A is a perspective view, and FIG. 11B is a plan view; FIG. 12A is a perspective view, and FIG. 12B is a plan view.

DESCRIPTION OF THE PREFERRED EMBODIMENTS

Figure 1:
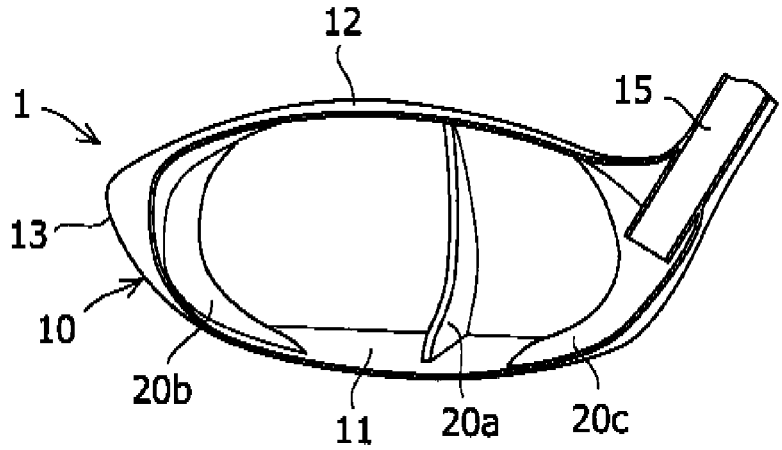
FIG. 1 is a front sectional view showing one embodiment of a golf club head in accordance with the present invention.
Figure 2:
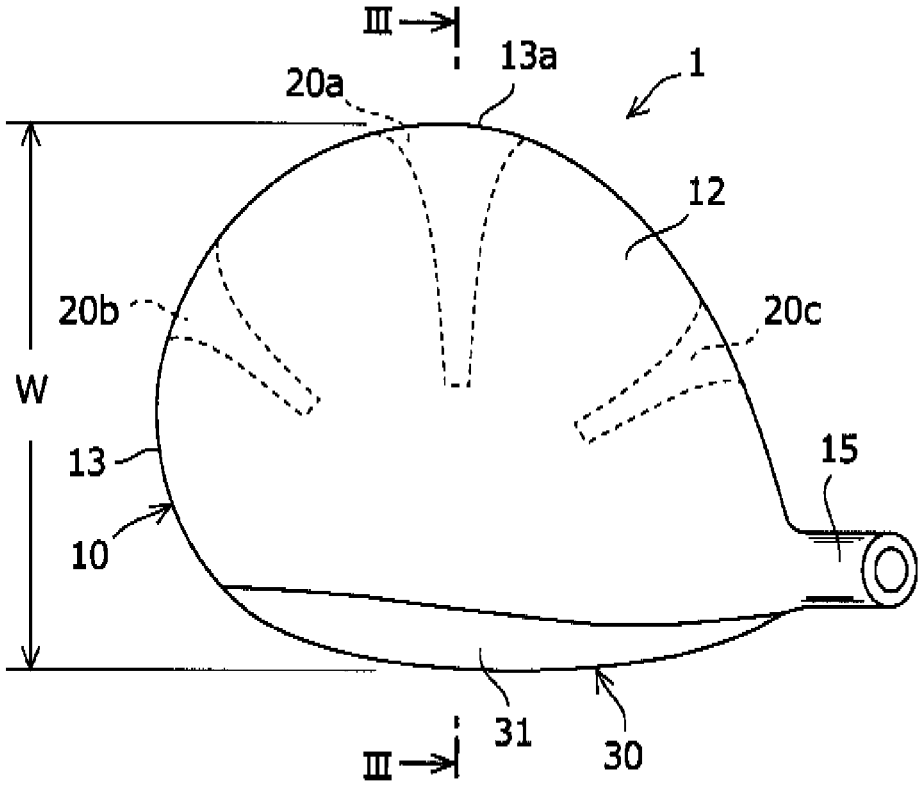
FIG. 2 is a plan view of the golf club head shown in FIG. 1.
Figure 3:
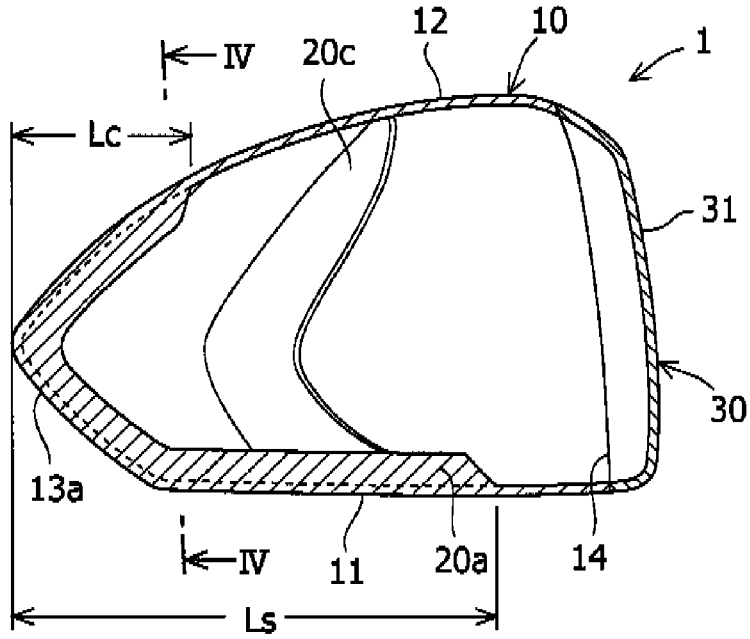
FIG. 3 is a side sectional view taken along the line III-III of FIG. 2.
Figure 4:
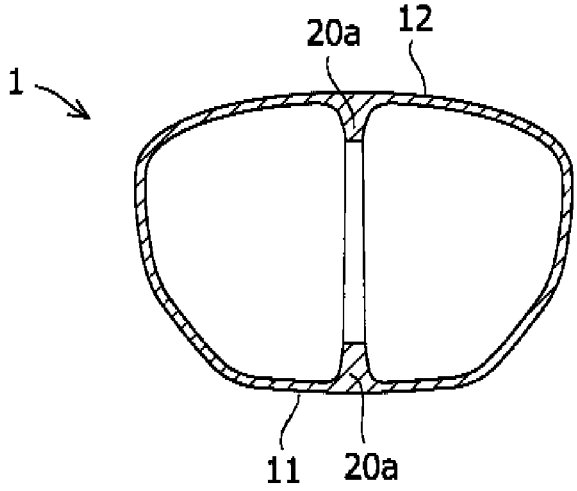
FIG. 4 is a sectional view taken along the line IV-IV of FIG. 3.

Embodiments of a golf club head in accordance with the present invention will now be described with reference to the accompanying drawings. FIG. 1 is a front sectional view showing one embodiment of a golf club head in accordance with the present invention, FIG. 2 is a plan view of the golf club head shown in FIG. 1, FIG. 3 is a side sectional view taken along the line III-III of FIG. 2, and FIG. 4 is a sectional view taken along the line IV-IV of FIG. 3.

As shown in FIGS. 1 to 4, a golf club head 1 includes a body member 10 having a sole part 11 and a crown part 12 and a face member 30 having a face part 31. The body member 10 is a member integrally molded by casting. The body member 10 and the face member 30 are joined to each other by welding or similar method, and the golf club head 1 thereby has a hollow structure.

The body member 10 includes the sole part 11, the crown part 12, a side part 13 that is positioned between the sole part and the crown part and extends around from the toe side to the heel side via the rear side, and a hosel part 15. Also, the body member 10 has a face opening 14 on the face side as shown in FIG. 2. The face opening 14 is configured so that the face member 30 is fitted therein.

Also, the body member 10 has an inner cavity 16, one end of which is the face opening 14. The inner cavity 16 is defined by the inner surfaces of the sole part 11, the crown part 12, the side part 13, and the wall surfaces of ribs 20. The ribs 20 extend substantially on the vertical surface from the inner surface ranging from the sole part 11 to the crown part 12 via the side part 13 when the golf club head 1 is placed at the ordinary address position. As shown in FIGS. 1 to 4, in this embodiment, the body member 10 is provided with three ribs 20*a* to 20*c* in the inner cavity therein. One rib 20*a* is located in a substantially central portion of the head. The remaining two ribs 20*b* and 20*c* are located on the toe side and the heel side of the head, respectively. All of the three ribs 20 extend from the side part 13 toward substantially central points of the sole part and the crown part.

Figure 5:
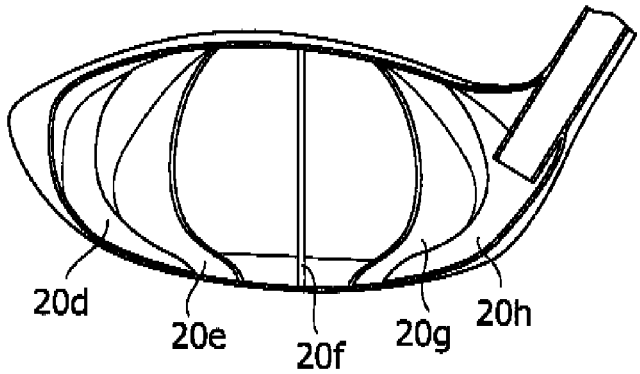
FIG. 5 is a front sectional view showing another embodiment of a golf club head in accordance with the present invention.

Although FIGS. 1 to 4 show a golf club head provided with three ribs 20, the golf club head in accordance with the present invention is not limited to this configuration. The golf club head in accordance with the present invention may be provided with one rib, or it may be provided with a plurality of ribs, preferably two to seven ribs, and more preferably two to five ribs. For example, as shown in FIG. 5, a body part 10*a* of the golf club head is provided with five ribs 20*d* to 20*h*. At least one rib is preferably arranged so as to extend from the sole part to the crown part passing through the rear-side side part (that is, a back surface). Thereby, the center of gravity of the head is moved to the back surface side, so that the moment of inertia can be increased. In the case in which plural ribs are provided, they can be arranged so as to pass through at least one of the side part on the toe side and the heel side. Also, the ribs are preferably designed so as to extend from the side part toward substantially central points of the sole part and the crown part or extend passing through the substantially central points of the sole part and the crown part.

As shown in FIG. 3, the horizontal length Ls of the rib 20 from the side part 13 to the sole part 11 is preferably not less than about 10 mm, more preferably is not less than about 15 mm. If this length Ls is made less than about 10 mm, the vibrations of the sole part will be low-frequency vibrations, so that the hitting sound is inferior. The rib 20 can be provided so as to extend to a portion in which the rib 20 comes into contact with the inner surface of the face part 31. However, the length Ls is preferably not greater than about 65 mm. As shown in FIG. 2, the horizontal length of the golf club head 1 from an outermost portion of the rear-side side part (the back surface) 13*a* to the outermost portion of the face part 31 (hereinafter, referred to as a "head width" W) is preferably about 100 mm to about 140 mm.

The horizontal length Lc of the rib 20 from the side part 13 to the crown part 12 is preferably equal to or less than the aforementioned horizontal length Ls from the side part 13 to the sole part 11. If the horizontal length Lc from the side part to the crown part is greater than the horizontal length Ls from the side part to the sole part, there arises a problem in that the center of gravity of the head is too high. The horizontal length Lc from the side part 13 to the crown part 12 is preferably not less than about 5 mm, and more preferably not less than about 6 mm.

The shape of the rib 20 is preferably such that the face-side tip end of the portion that is in contact with the inner surface of the sole part 11 and the face-side tip end of the portion that is in contact with the inner surface of the crown part 12 are connected to each other substantially in a linear shape or a curved shape, or a combination of these shapes. In particular, a substantially C shape such that the tip ends are connected to each other after the connection line has once been curved to the head outside direction from the two tip ends is more preferable. By making the rib 20 substantially in the C shape, the moment of inertia of the head can be increased and the effect of restraining vibrations of the sole part and the crown part is maintained.

The thickness of the rib 20 is preferably not less than about 1 mm, and more preferably not less than about 1.2 mm, at positions at which the rib 20 is in contact with the inner surfaces of the sole part 11, the crown part 12, and the side part 13. If the thickness of the rib is less than about 1 mm, there arises a problem in that a misrun may occur at the time of casting, and thereby the rib may be broken. Also, the thickness of the rib is preferably not greater than about 4 mm, and more preferably not greater than 3.8 mm, at the positions at which the rib 20 is in contact with the inner surfaces. If the thickness of the rib is greater than about 4 mm, the excessive thickness may produce a misrun, or the rib weight may increase, which presents a problem in that it hinders larger head size or increased head weight. The weight of the rib 20 is preferably not less than about 5 g and preferably not more than 40 g.

As shown in FIG. 4, the wall surface of the rib 20 can be made in a curved shape in portions in which the rib 20 is in contact with the inner surfaces of the sole part 11, the crown part 12, and the side part 13. Thereby, when the body member 10 is cast, the flow of molten metal to the rib 20 can be ensured. Also, even in thin portions of the sole part 11, the crown part 12, and the side part 13 with which the rib 20 is not in contact, the flow of molten metal can be ensured.

As shown in FIG. 4, the thickness of the rib 20 is preferably smaller at the position at which the rib 20 is in contact with the crown part 12 than at the position at which the rib 20 is in contact with the sole part 11. Thereby, since the rib weight is lower on the crown side than on the sole side, the center of gravity of the golf club head can be reduced. For example, the rib thickness on the crown side can be made less than that on the sole side by at least about 0.1 mm, preferably by at least about 0.5 mm.

As shown in FIG. 2, the thickness of the rib 20 is preferably less at the tip end portion on the head center side than the portion on the head outside or the shell side, that is, the portion in which the rib is in contact with the inner surface of the sole part 11, the side part 13, or the crown part 12. Thereby, when the body member 10 is cast, the flow of molten metal to the rib 20 can be ensured. Also, thereby, since the center of gravity of the golf club head shifts to the rear side, the moment of inertia of the head can be increased. For example, the thickness of the tip end portion of the rib 20 can be made less than that in the outside portion of the rib 20 by at least about 0.1 mm, preferably by at least about 0.5 mm.

As a method for casting the body member 10, a method in which a mold is formed by investment casting, and molten metal is poured into the mold by vacuum centrifugal casting, is preferably used. However, the casting method is not limited to this method. For example, a casting machine manufactured by Consarc Corporation can be used. The face member 30 is preferably manufactured by press molding, although the manufacturing method for the face member 30 is not limited to this method. The body member 10 and the face member 30 can be fixed to each other by welding or the like method.

The thicknesses of the sole part 11, the crown part 12, and the side part 13 constituting the body member 10 are preferably made not larger than about 1.2 mm to increase the size of the golf club head. Also, the thicknesses thereof are preferably made not smaller than about 0.6 mm to avoid the decrease in rigidity caused by smaller thickness.

The area of the sole part 11 is preferably not less than about 5000 $mm^2$, and preferably not more than about 17000 $mm^2$. The area of the crown part 12 is preferably made not less than about 1000 $mm^2$ so as to increase the moment of inertia and the volume. Also, the area of the crown part 12 is preferably made not larger than about 17000 $mm^2$ because of the limitation under the rule. The weight of the golf club head 1 is preferably not less than about 150 g and preferably not more than about 250 g in consideration of the swing balance of the golf club. If the golf club is a driver, the weight thereof is preferably not less than about 170 g and preferably not more than about 230 g. The volume of the golf club head 1 is preferably not less than about 400 $mm^2$ and preferably not more than about 500 $mm^2$.

The body member 10 and the face member 30 can be manufactured of a metallic material having the same or differing composition. The body member 10 is preferably manufactured of a titanium alloy, aluminum alloy, or magnesium alloy. For example, a titanium alloy (Ti-6Al-4V) having a composition of 5.5-6.75 wt % Al and 3.5-4.5 wt % V, the balance being Ti and unavoidable impurities, can be used. The body member 10 may be manufactured of stainless steel. Also, the face member 30 is preferably manufactured of a titanium alloy or aluminum alloy. For example, the aforementioned Ti-6Al-4V or AMS-A201 (aluminum alloy) can be used.

In the embodiment explained with reference to FIGS. 1 to 4, an explanation has been given of an example in which the body member 10 includes the sole part 11, the crown part 12, the side part 13, the hosel part 15, and the ribs 20, and the face member 30 includes the face part 31. However, the present invention is not limited to this configuration. For example, if the body member includes the ribs, the configuration can be made such that the face member includes parts of the sole part, the crown part, at least one of the side part, the face part, and the hosel part, and the body member includes the remaining of the sole part, the crown part, and the side part.

EXAMPLES

The golf club heads of examples 1 to 7, having configurations shown in FIGS. 6 to 12, were manufactured, and the performances thereof were evaluated. The specifications and evaluation results of the golf club heads of examples 1 to 7 are given in Table 1. Also, as comparative example 1, a golf club head without a rib was manufactured, and the performance thereof was also evaluated. In all of the examples and the comparative example, the Ti-6Al-4V alloy was used. Also, the head width W was set at 116 mm, and the head weight was set at about 195 g.

Figure 6A:
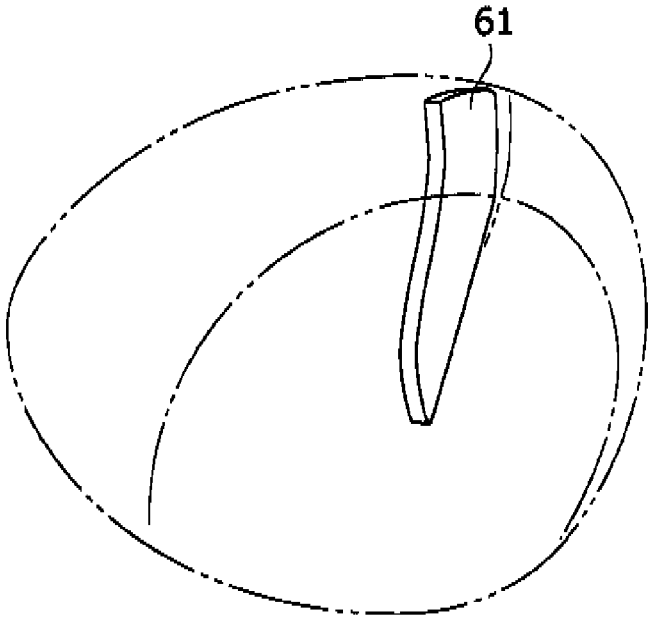
FIGS. 6A and 6B are schematic views showing the construction of a rib of Example 1.
Figure 6B:
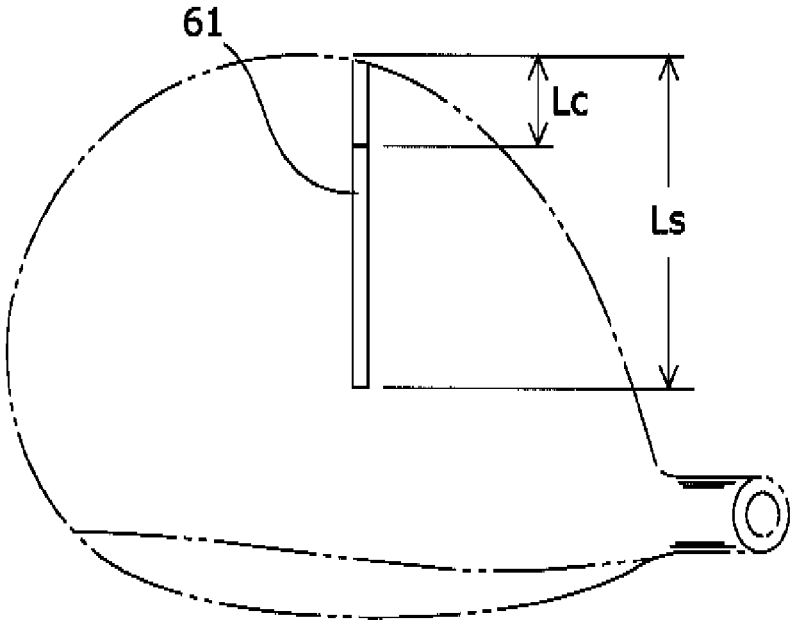

In example 1, a rib 61 as shown in FIG. 6 was provided. For this rib 61, the horizontal length Ls from the side part to the sole part was set at 67 mm, and the horizontal length Lc from the side part to the crown part was set at 16 mm. Also, the thickness of the rib 61 was set at 3 mm.

Figure 7A:
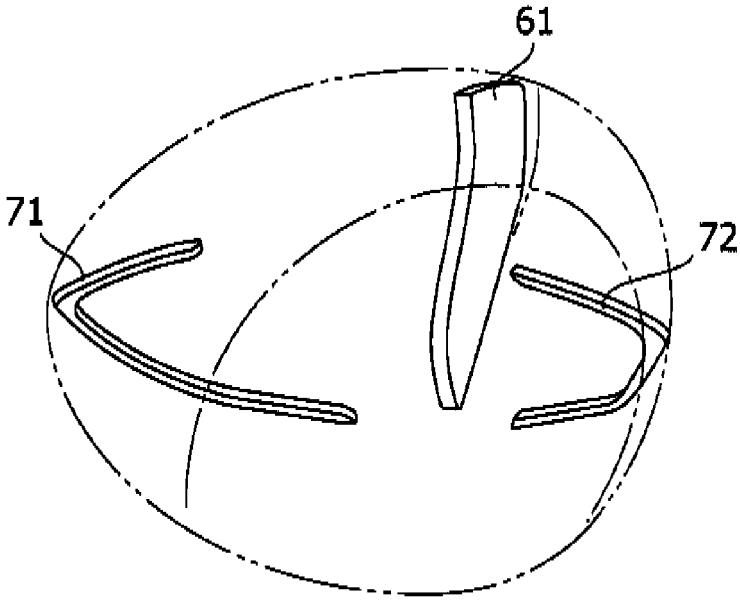
FIGS. 7A and 7B are schematic views showing the construction of a rib of Example 2.
Figure 7B:
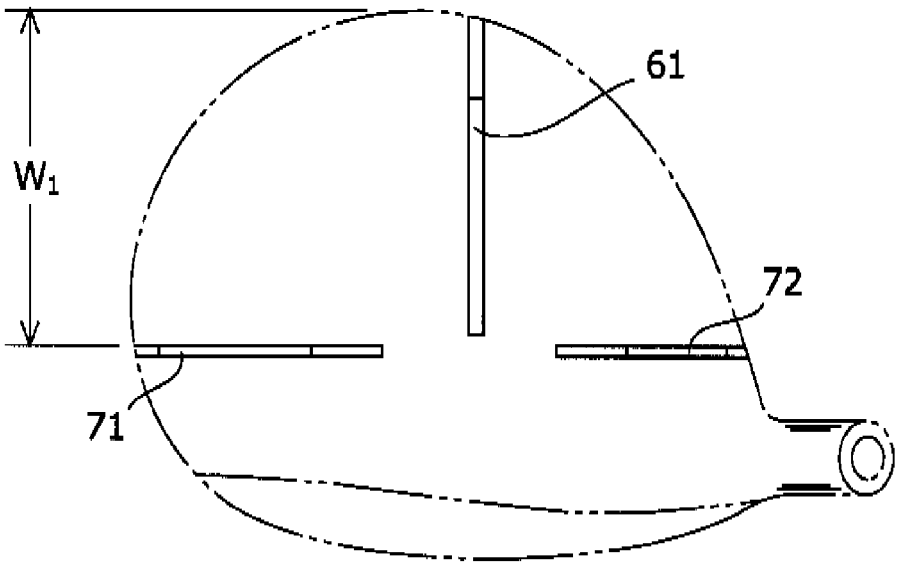

In example 2, as shown in FIG. 7, in addition to the above-described rib 61 in the center, two ribs 71 and 72, extending in the perpendicular direction with respect to the central rib 61, were provided at positions at a distance $W_1$ of 69 mm horizontally from the outermost portion of the back surface. For the rib 71 on the toe side, the length Ls was set at 48 mm, and the length Lc was set at 33.5 mm. Also, for the rib 72 on the heel side, the length Ls was set at 36 mm, and the length Lc was set at 22 mm. The thicknesses of the ribs 71 and 72 on the toe side and the heel side each were set at 2 mm.

Figure 8A:
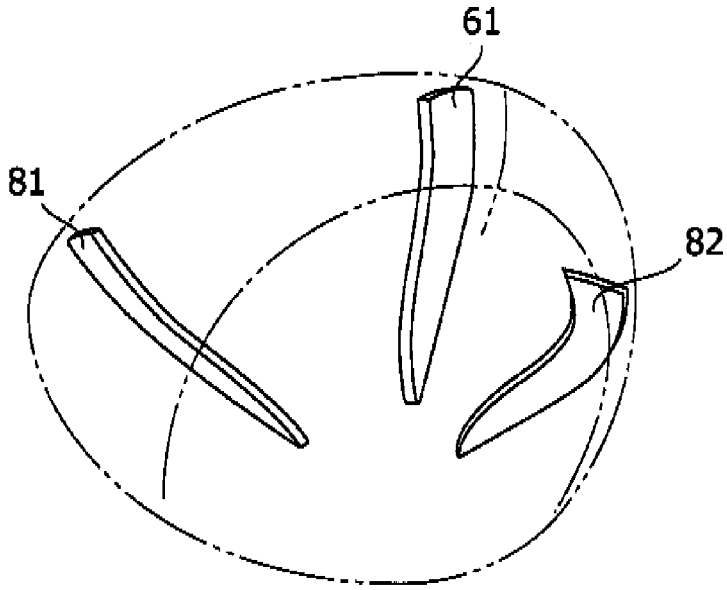
FIGS. 8A and 8B are schematic views showing the construction of a rib of Example 3.
Figure 8B:
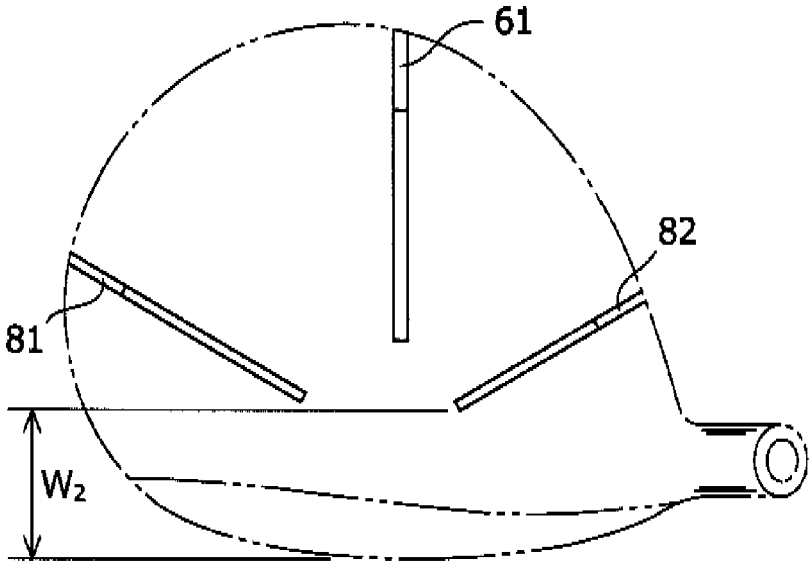

In example 3, as shown in FIG. 8, in addition to the rib 61 in the center, two ribs 81 and 82, extending obliquely with respect to the central rib 61, were provided. The two ribs 81 and 82 were provided so that the face-side tip end of a portion of each of the two ribs, which portion is in contact with the inner surface of the sole part, was located at a position at a distance $W_2$ of about 31 mm horizontally from the outermost portion of the face surface. For the rib 81 on the toe side, the length Ls was set at 64 mm, and the length Lc was set at 20 mm. Also, for the rib 82 on the heel side, the length Ls was set at 40 mm, and the length Lc was set at 20 mm. The thicknesses of all of the three ribs were each set at 2 mm.

Figure 9A:
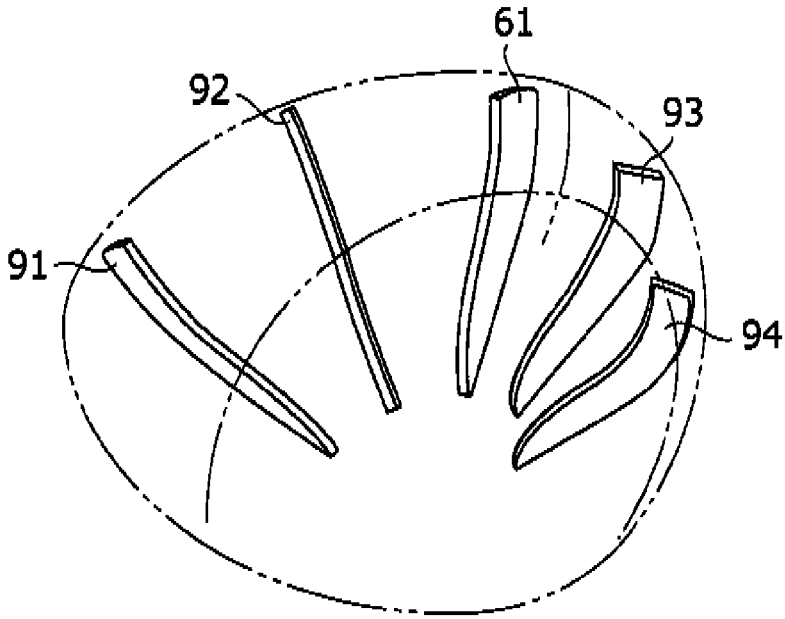
FIGS. 9A and 9B are schematic views showing the construction of a rib of Example 4.
Figure 9B:
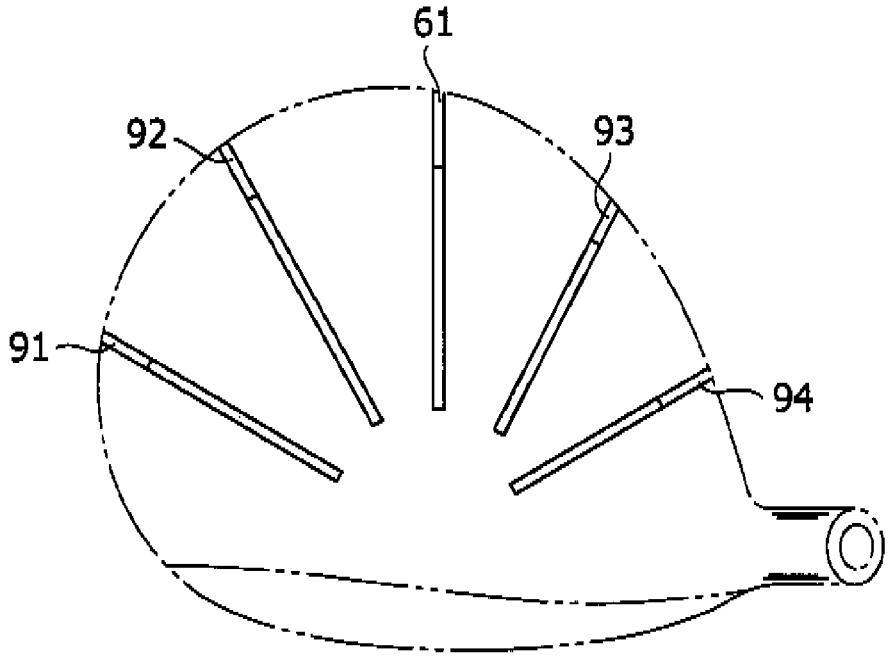

In example 4, as shown in FIG. 9, in addition to the rib 61 in the center, four ribs 91 to 94, extending radially from a position near the center of the face surface, were provided. Of these four ribs, the rib 91 closest to the face surface on the toe side and the rib 94 closest to the face surface on the heel side were provided so that the face-side tip end of a portion that is in contact with the inner surface of the sole part was located at a distance of about 32 mm horizontally from the outermost portion of the face surface. For the rib 91 closest to the face surface on the toe side, the length Ls was set at 61 mm, and the length Lc was set at 18 mm. For the toe-side intermediate rib 92, the length Ls was set at 52 mm, and the length Lc was set at 20 mm. For the heel-side intermediate rib 93, the length Ls was set at 50 mm, and the length Lc was set at 20 mm. For the rib 94 closest to the face surface on the heel side, the length Ls was set at 60 mm, and the length Lc was set at 50 mm. The thickness of the rib 91 closest to the face surface on the toe side was set at 1.5 mm, and the thicknesses of the remaining four ribs were each set at 1.0 mm.

Figure 10A:
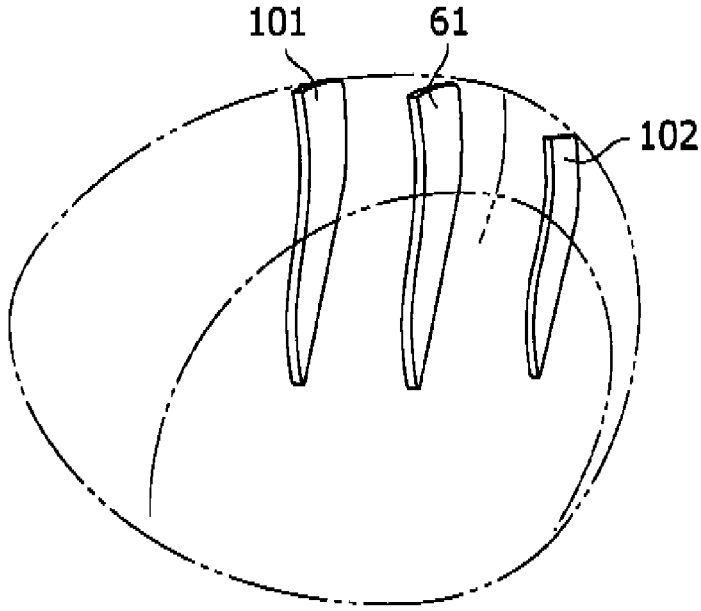
FIGS. 10A and 10B are schematic views showing the construction of a rib of Example 5.
Figure 10B:
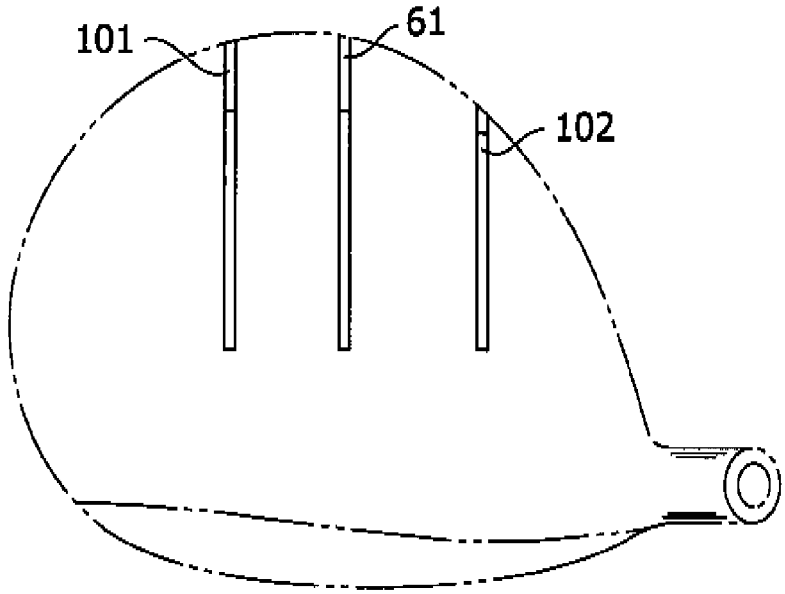

In example 5, as shown in FIG. 10, in addition to the rib 61 in the center, two ribs 101 and 102, extending in parallel with the central rib 61, were provided. All of the three ribs were provided so that the face-side tip end of a portion that is in contact with the inner surface of the sole part was located at a distance of about 47 mm horizontally from the outermost portion of the face surface. For the rib 101 on the toe-side, the length Ls was set at 63 mm, and the length Lc was set at 15 mm. For the rib 102 on the heel side, the length Ls was set at 54 mm, and the length Lc was set at 7 mm. The thicknesses of all of the three ribs were each set at 2 mm.

Figure 11A:
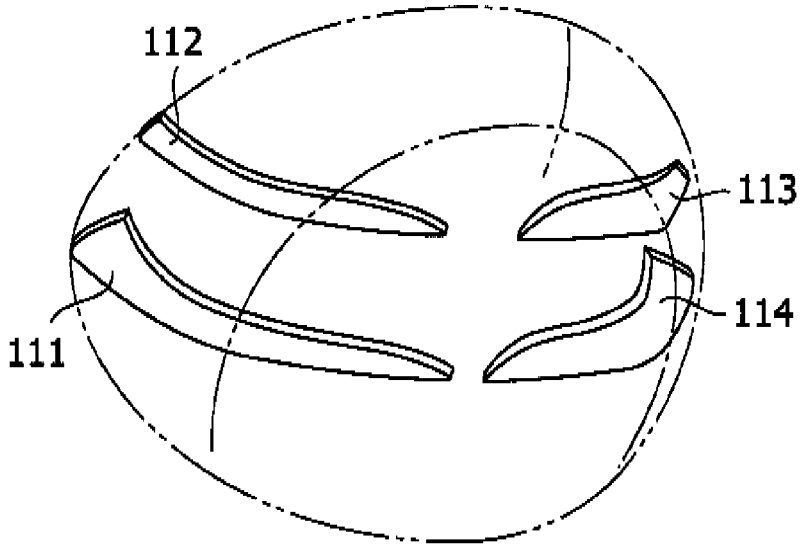
FIGS. 11A and 11B are schematic views showing the construction of a rib of Example 6.
Figure 11B:
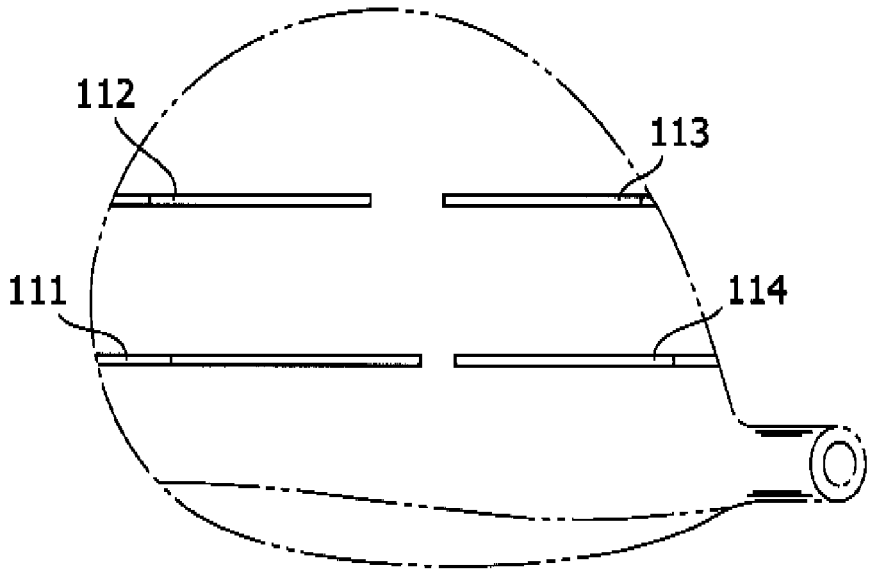

In example 6, as shown in FIG. 11, at a position of 69 mm from the outermost portion of the back surface, two ribs 111 and 114, extending in parallel with the face surface, were provided in the side part on the toe side and on the heel side. Also, at a location 39 mm from the outermost portion of the back surface, two ribs 112 and 113 extending in parallel with the face surface were provided similarly. For the rib 111 on the toe side and on the face side, the length Ls was set at 66 mm, and the length Lc was set at 16 mm. For the rib 112 on the toe side and on the rear side, the length Ls was set at 53 mm, and the length Lc was set at 7 mm. For the rib 113 on the heel side and on the rear side, the length Ls was set at 41 mm, and the length Lc was set at 4 mm. For the rib 114 on the heel side and on the face side, the length Ls was set at 51 mm, and the length Lc was set at 8 mm. The thickness of the rib 112 on the toe side and on the rear side was set at 2.0 mm, and the thicknesses of the remaining three ribs were each set at 2.5 mm.

Figure 12A:
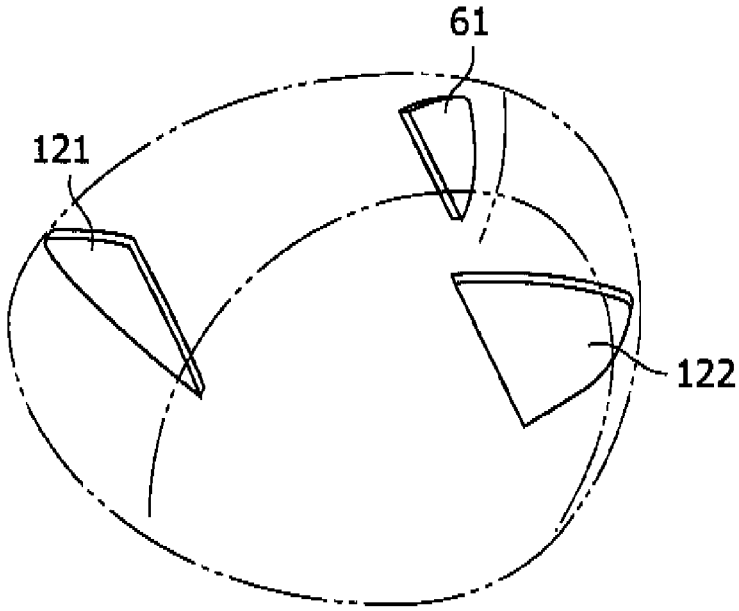
FIGS. 12A and 12B are schematic views showing the construction of a rib of Example 7.
Figure 12B:
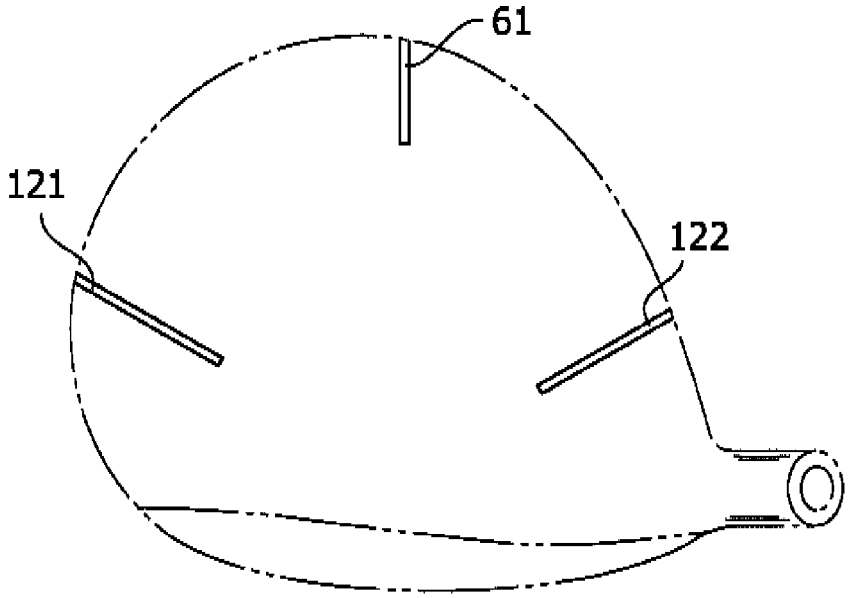

In example 7, as shown in FIG. 12, in addition to the rib 61 in the center, two ribs 121 and 122, extending obliquely with respect to the central rib 61, were provided. The two ribs 121 and 122 were provided so that the face-side tip end of a portion that is in contact with the inner surface of the sole part is located at a distance of about 39 mm horizontally from the outermost portion of the face surface. For the rib 121 on the toe side, the length Ls and the length Lc were set so as to be equal to each other and were 34 mm. For the rib 122 on the heel side, the length Ls and the length Lc were set so as to be equal to each other and were 29 mm. For the central rib 61, the length Ls and the length Lc were set so as to be equal to each other and were 23 mm. Also, the thicknesses of all of the three ribs were each set at 2 mm.

TABLE 1

| | Comparative Example | Example | | | | | | |
|---|---|---|---|---|---|---|---|---|
| | 1 | 1 | 2 | 3 | 4 | 5 | 6 | 7 |
| Weight [g] | 189.6 | 189.8 | 189.7 | 189.6 | 189.5 | 189.5 | 190.3 | 189.6 |
| DYG [mm] | 2.4 | 4.1 | 4.4 | 3.9 | 3.8 | 4.0 | 3.9 | 4.9 |
| ZG [mm] | 34.0 | 36.2 | 35.9 | 34.7 | 35.4 | 36.8 | 33.7 | 33.9 |
| IX [g · cm$^2$] | 2563 | 2758 | 2753 | 2558 | 2625 | 2805 | 2470 | 2479 |
| IY [g · cm$^2$] | 4130 | 4513 | 4480 | 4633 | 4570 | 4705 | 4450 | 4667 |
| HGR [mm] | 25.6 | 26.9 | 27.2 | 26.4 | 26.2 | 26.1 | 27.1 | 27.6 |
| Distance of center of gravity [mm] | 43.5 | 45.6 | 45.5 | 46.9 | 47.0 | 47.4 | 45.2 | 47.1 |
| Angle of center of gravity [°] | 20.3 | 22.9 | 22.9 | 20.5 | 21.2 | 22.7 | 20.4 | 19.8 |
| Volume [mm$^3$] | 452 | 452 | 452 | 452 | 452 | 452 | 452 | 452 |
| Sole thickness [mm] | 0.8 | 0.8 | 0.8 | 0.8 | 0.8 | 0.8 | 0.8 | 0.8 |
| Crown thickness [mm] | 0.7 | 0.7 | 0.7 | 0.7 | 0.7 | 0.7 | 0.7 | 0.7 |
| Side thickness [mm] | 0.7 | 0.7 | 0.7 | 0.7 | 0.7 | 0.7 | 0.7 | 0.7 |
| Sole area [mm$^2$] | 6932 | 6932 | 6932 | 6932 | 6932 | 6932 | 6932 | 6932 |
| Crown area [mm$^2$] | 11597 | 11597 | 11597 | 11597 | 11597 | 11597 | 11597 | 11597 |

Table 1

1: Comparative example

2: Example

3: Weight

4: Distance of center of gravity

5: Angle of center of gravity

6: Volume

7: Sole thickness

8: Crown thickness

9: Side thickness

10: Sole area

11: Crown area

DYG: Vertical distance from the face center to the position of center of gravity on the face surface (mm)

ZG: Depth of center of gravity of the head (mm)

IX: Geometrical moment of inertia of a reference cross section with respect to x-axis (g·cm$^2$)

IY: Geometrical moment of inertia of a reference cross section with respect to y-axis (g·cm$^2$)

HGR: Height of center of gravity of the head (mm)

As shown in Table 1, in comparative example 1 without a rib, a low sound was produced when a golf ball was hit. On the other hand, in examples 1 to 7 with rib(s), the hitting sound was high. Also, in comparative example 1 without a rib, the moment of inertia IY was as low as about 4100 g·cm$^2$, whereas the moments of inertia IY of examples 1 to 7 with rib(s) were increased to about 4400 g·cm$^2$ or higher.

What is claimed is:

1. A golf club head having a hollow space therein, which is made of a metal, comprising:

a first member comprising at least a face part; and a second member comprising at least a part of a sole part, at least a part of a crown part, at least a part of a side part, and a plurality of ribs, wherein each of the plurality of ribs extends from the inner surface of at least a part of the sole part to the inner surface of at least a part of the crown part via the inner surface of at least a part of the side part, and each of the plurality of ribs is cast integrally with at least a part of the sole part, at least a part of the crown part, and at least a part of the side part wherein a tip end portion of each of the plurality of ribs on the head center side is thinner than a portion that is in contact with the inner surface of the sole part, the inner surface of the side part, or the inner surface of the crown part.

2. The golf club head according to claim 1, wherein each of the plurality of ribs has a thickness of about 1 mm to about 4 mm.

3. The golf club head according to claim 1, wherein each of the plurality of ribs has a horizontal length Ls from the side part to the sole part of about 30 mm to about 70 mm.

4. The golf club head according to claim 1, wherein each of the plurality of ribs has a weight of about 5 g to about 40 g.

5. The golf club head according to claim 1, wherein each of the plurality of ribs has substantially a C shape extending from the inner surface of the crown part to the inner surface of the sole part via the inner surface of the side part.

6. The golf club head according to claim 1, wherein the horizontal length Ls from the side part to the sole part is equal to or longer than a horizontal length Lc of each of the plurality of ribs from the side part to the crown part.

7. The golf club head according to claim 1, wherein a first rib of the plurality of ribs is disposed centrally on a back surface of the second member.

8. The golf club head according to claim 7, wherein a second rib of the plurality of ribs is disposed on a toe side of the second surface and a third rib of the plurality is disposed on a heel side of the second surface.

9. The golf club head according to claim 1, wherein the ribs suppress a low and muffled sound when a golf ball is struck.

10. The golf club head according to claim 1, wherein each of the plurality of ribs extends toward substantially central points of the sole part and the crown part, and wherein a central rib of the plurality of ribs has a longer horizontal length from the side part to the sole part than a side rib of the plurality of ribs.

11. The golf club head according to claim 1, wherein each of the plurality of ribs extends substantially toward the face part, and wherein a central rib of the plurality of ribs has a longer horizontal length from the side part to the sole part than a side rib of the plurality of ribs.

* * * * *